US005932847A

United States Patent [19]

Mayfield

[11] Patent Number: 5,932,847

[45] Date of Patent: Aug. 3, 1999

[54] FLAME RETARDANT PLENUM CABLE

[75] Inventor: Michael H. Mayfield, Port Jervis, N.Y.

[73] Assignee: Remee Products Corporation, Florida, N.Y.

[21] Appl. No.: 08/644,131

[22] Filed: May 10, 1996

[51] Int. Cl.[6] ..... H01B 11/04

[52] U.S. Cl. ..... 174/113 R; 174/121 A; 174/107; 174/110 FC

[58] Field of Search ..... 174/113 R, 107, 174/121 A, 34, 110 FC

[56] References Cited

U.S. PATENT DOCUMENTS

| | | | |
|---|---|---|---|
| 3,433,890 | 3/1969 | Gabriel et al. | 174/116 |
| 3,489,844 | 1/1970 | Motley | 174/32 |
| 3,650,827 | 3/1972 | Brown et al. | 428/383 |
| 3,678,177 | 7/1972 | Lawrenson | 174/113 C |
| 4,408,443 | 10/1983 | Brown et al. | 57/204 |
| 4,412,094 | 10/1983 | Dougherty et al. | 174/110 F |
| 4,423,589 | 1/1984 | Hardin et al. | 57/293 |
| 4,446,689 | 5/1984 | Hardin et al. | 57/204 |
| 4,500,748 | 2/1985 | Klein | 174/121 A |
| 4,605,818 | 8/1986 | Arroyo et al. | 174/107 |
| 4,687,294 | 8/1987 | Angeles | 178/63 D |
| 4,697,051 | 9/1987 | Beggs et al. | 174/34 |
| 4,744,629 | 5/1988 | Bertoglio et al. | 350/96.2 |
| 4,873,393 | 10/1989 | Friesen et al. | 174/34 |
| 4,941,729 | 7/1990 | Hardin et al. | 350/96.23 |
| 4,969,706 | 11/1990 | Hardin et al. | 174/107 |
| 5,001,304 | 3/1991 | Hardin et al. | 174/107 |
| 5,010,210 | 4/1991 | Sidi et al. | 174/34 |
| 5,024,506 | 6/1991 | Hardin et al. | 350/96.23 |
| 5,074,640 | 12/1991 | Hardin et al. | 385/109 |
| 5,162,609 | 11/1992 | Adriaenssens et al. | 174/34 |
| 5,173,960 | 12/1992 | Dickenson | 385/100 |
| 5,202,946 | 4/1993 | Hardin et al. | 385/109 |
| 5,253,317 | 10/1993 | Allen et al. | 385/109 |
| 5,298,680 | 3/1994 | Kenny | 174/36 |
| 5,378,856 | 1/1995 | Allen | 174/120 R |
| 5,424,491 | 6/1995 | Walling et al. | 174/113 R |
| 5,493,071 | 2/1996 | Newmoyer | 174/113 R |

FOREIGN PATENT DOCUMENTS

| | | |
|---|---|---|
| 0380245 A1 | 1/1990 | European Pat. Off. . |
| 25 18 621 | 10/1976 | Germany . |

OTHER PUBLICATIONS

Berk–Tek Product Specification, Drawing Number 230042, Part Number BTTB–24–25D–P/HX, Dated Aug. 12, 1987, pp. 1–3.

Essex Group, Inc. Bulletin 2021–0391, Inside Premises Wiring, 1991.

Underwriters Laboratories Inc., File E107869, Project 90ME13368, Report on Communications Cable, Teledyne Thermatics, Elm City, NC, Sep. 25, 1990.

Underwriters Laboratories Inc., File E113333, Vol. 1, Sec. 14, Report on a Communication Cable, Issued Jul. 12, 1991, Revised Jan. 17, 1995, pp. 1–2.

Teledyne Thermatics, Elm City, North Carolina, Type 2 Data & Telephone Plenum Cable, Drawing No. 12632/3, dated May 16, 1990,pp. 1–3.

Champlain Cable Corp. News Release, Notice 190 4, dated Feb. 8, 1990.

Journal of Vinyl Technology, vol. 7, No. 3, Sep. 1985 pp. 107–111.

International Wire & Cable Symposium Proceedings 1987, Reduced Emissions Plenum Cable Jacket Compounds, M.J. Keogh, pp. 592–597.

*Primary Examiner*—Kristine Kincaid
*Assistant Examiner*—William Mayo, III
*Attorney, Agent, or Firm*—Orrick, Herrington & Sutcliffe LLP

[57] ABSTRACT

A communication cable includes a first plurality of twisted pairs of electrical conductors, wherein each electrical conductor is surrounded by a layer of plenum rated insulation. The cable also includes a second plurality of twisted pairs of electrical conductors, wherein one conductor of each pair is surrounded by a layer of plenum rated insulation and the other electrical conductor is surrounded by a layer of non-plenum rated insulation. In an alternate embodiment, a communication cable includes a plurality of twisted pairs of electrical conductors, each pair having a first insulating material about one of the electrical conductors and a second insulating material about the second electrical conductor.

18 Claims, 2 Drawing Sheets

FLAME RETARDANT PLENUM CABLE

FIELD OF THE INVENTION

The present invention relates generally to flame retardant communication cables for use in a plenum. More specifically, the present invention relates to communication cables able to meet or exceed the requirements of Underwriters Laboratories Tunnel Flame Test UL 910.

BACKGROUND OF INVENTION

As communications and communication services have increased, it has become necessary to provide communication cables in larger and larger numbers. This is particularly true in office buildings where more and more communication services are being demanded. Typically, rather than rewire an existing building, it has been found more economical to provide the needed communication services by running the communication cables in plenums. In general, a plenum is defined as a compartment or chamber to which one or more air ducts are connected and which forms part of the air distribution system. Generally, in existing buildings, plenums are readily formed by providing drop ceilings, which is typically a return air plenum, in a facility being rewired. Another alternative is to create a plenum beneath a raised floor of a facility.

From the above it is readily understood why it would be very advantageous to utilize a wiring scheme within these fairly accessible places. However, because these plenums handle environmental air, there is considerable concern regarding the hazards resulting from a fire. This concern is addressed in the National Electrical Code by requiring that communications cables for use in plenums pass a stringent flame and smoke evaluation. Consequently, in the manufacture of communication cables, the fire resistance ratings which allow for installation within certain areas of a building are of significant importance.

Currently, communication cables for use in plenums must meet the requirements of the Underwriter's Laboratory Standard 910, which is a Test Method For Fire and Smoke Characteristics of Cables Used In Air-Handling Spaces. This well known test, which is performed in a modified Steiner Tunnel, is a severe test that can be passed by communication cables using certain premium materials for insulation such as low smoke materials, for example, fluorinated ethylenepropylene (FEP), ethylene trifluorochloroethylene, or polyvinylidene fluoride (PVDF). In general, cables using such insulation materials which meet this test are approximately three times more expensive than a lower rated cable designed for the same communication application. However, communication cables failing this test must be installed within conduit, thereby eliminating the benefits of an economical, easily relocatable cable scheme.

In general, the manufacture of communication cables are well known. For example, U.S. Pat. No. 4,423,589, issued to Hardin et al. on Jan. 3, 1984 discloses a method of manufacturing a communications cable by forming a plurality of wire units by advancing groups of twisted wire pairs through twisting stations. Further, U.S. Pat. No. 4,446,689 issued to Hardin et al. on May 8, 1984 relates to an apparatus for manufacturing a communications cable wherein disc frames are provided with aligned apertures in which faceplates are movably mounted. During operation, the faceplates are modulated in both frequency and amplitude.

Likewise, the current materials for use in communication cables are also well known. For example, U.S. Pat. No. 5,001,304 issued to Hardin et al. on Mar. 19, 1991 relates to a building riser cable having a core which includes twisted pairs of metal conductors, wherein the insulating covers are formed from a group of materials including polyolefin. It should be noted however, that the flame test used for riser cables is much less severe than the flame test used for plenum cables.

U.S. Pat. No. 5,024,506 issued to Hardin et al. on Jun. 18, 1991 discloses a plenum cable that includes non-halogenated plastic insulation materials. The insulating material about the metallic conductors is selected from the group consisting of a polyetherimide, and a silicone-polyimide copolymer, or a blend of the two. Similarly, in U.S. Pat. No. 5,074,640 issued to Hardin et al. on Dec. 24, 1991 a plenum cable is described that includes an insulator containing a polyetherimide and an additive system including an antioxidant/thermal stabilizer and a metal deactuator.

U.S. Pat. No. 4,500,748 issued to Klein on Feb. 19, 1985 relates to a flame retardant plenum cable wherein the insulation and the jacket are made from the same or different polymers to provide a reduced amount of halogens.

U.S. Pat. No. 4,605,818 issued to Arroyo et al. on Aug. 12, 1986 relates to a flame retardant plenum cable wherein the conductor insulation is a polyvinyl chloride plastic provided with a flame retardant, smoke suppressive sheath system.

U.S. Pat. No. 4,678,294 issued to Angeles on Aug. 18, 1987 relates to a fiber optic plenum cable. The optical fibers are provided with a buffer layer surrounded by a jacket. The cable is also provided with strength members for rigidity.

U.S. Pat. No 5,493,071 issued to Newmoyer on Feb. 20, 1996 relates to a plenum cable for communications use wherein at least one of the twisted pairs of the cable has a "non-plenum rated" insulation material while the remaining twisted pairs have a "plenum rated" insulation material. Newmoyer defines "plenum rated insulation" as "those materials that would allow a cable to pass standard industry plenum tests if it were used on all of the twisted pairs of electrical conductors of a cable" and "non-plenum rated insulation" is defined as "those materials that would significantly contribute to a cable failing standard industry plenum tests if it were used on all of the twisted pairs of electrical conductors of a cable." Newmoyer further discloses that the twisted pair having the shortest twist length have the non-plenum rated insulation.

It can thus be understood that much work has been dedicated to providing not only communication cables that meet certain safety requirements but meet electrical requirements as well. Nevertheless, the most common communication cable that is in widest use today includes a plurality of twisted pairs of electrical conductors each having an insulation of FEP, which is a very high temperature material and possesses those electrical characteristics, such as, low dielectric constant and dissipation factor, necessary to provide high quality communications cable performance. However, FEP is quite expensive and is frequently in short supply.

Consequently, the provision of a communication cable for use in plenums but has a reduced use of FEP is highly desired.

SUMMARY OF THE INVENTION

It is, therefore, an object of the present invention to provide a communication cable for use in a plenum which reduces the amount of FEP or other scarce materials and, hence, increases the availability of the communication cable.

It is a further object of the present invention to provide a plenum cable which limits the use of "non-plenum"

material, thereby minimizing the amount of material likely to contribute to the production of smoke or the flammability of the cable.

It is yet another object of the present invention to mitigate the propagation delay skew inherent in a cable manufactured with a combination of plenum and non-plenum materials.

These objects are accomplished in accordance with the present invention by a communication cable that has a first plurality of twisted pairs of electrical conductors having a first insulating material about each electrical conductor thereof and a second plurality of twisted pairs of electrical conductors having a first insulation material about one conductor of each pair and a second insulation material about the other electrical conductor.

In one particular aspect of the invention, the communication cable includes four twisted pairs of electrical conductors wherein the electrical conductors of two of the four pairs are insulated with a material that is a plenum rated material, wherein the insulation of the electrical conductors of the two remaining pairs is a combination of non-plenum rated insulation material on one conductor of the pair and plenum rated insulation on the other conductor of the pair.

In another aspect of the invention, the communication cable includes a plurality of twisted pairs of electrical conductors wherein each pair has a first insulating material about one of the electrical conductors and a second insulating material about the second electrical conductor.

These and other objects, features and advantages of the present invention will be apparent and fully understood from the following detailed description of the preferred embodiments, taken in connection with the appended drawings.

BRIEF DESCRIPTION OF THE DRAWINGS

The present invention can be better understood when considered with the following drawings wherein.

DETAILED DESCRIPTION OF THE PREFERRED EMBODIMENT

Figure 1:
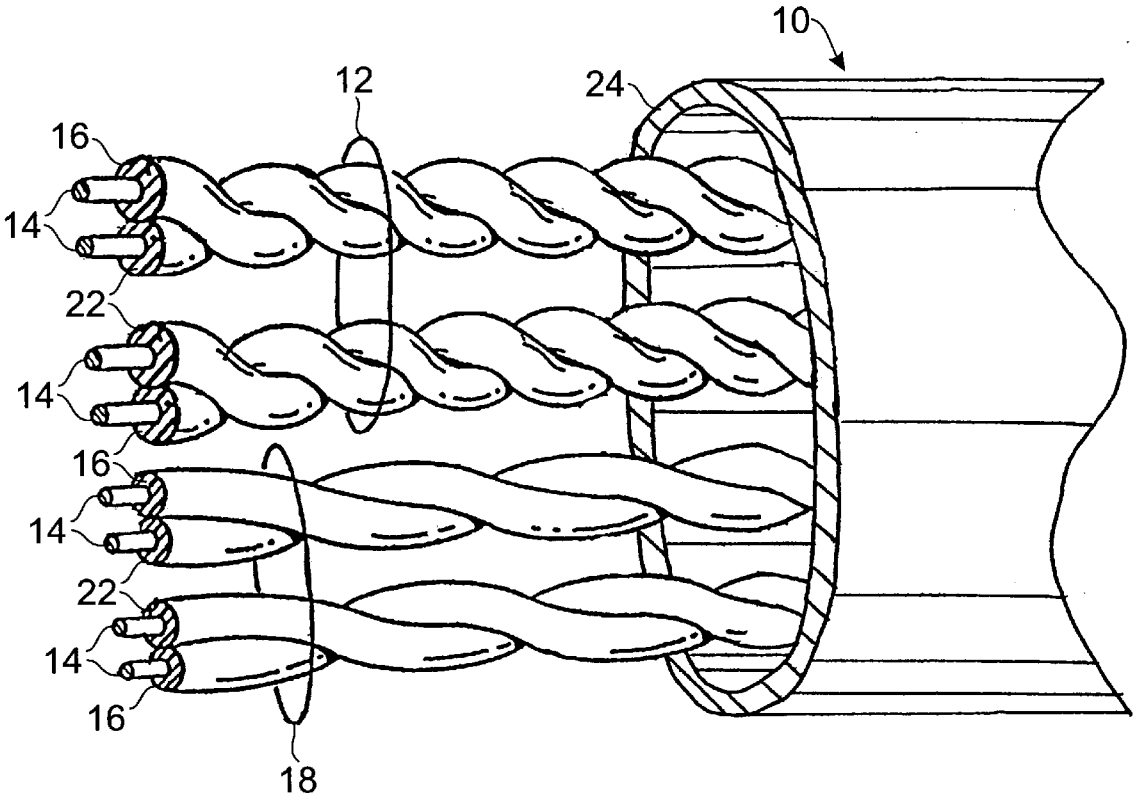
FIG. 1 is a perspective view of a fire retardant plenum cable according to the present invention.

A communication cable, generally indicated at 10 in FIG. 1 and embodying the principles of the present invention, includes a plurality of twisted pairs of electrical conductors, of which some are twisted pairs 12 and at least two are twisted pairs 18, as will be described. Regarding the twisted pairs 12, each conductor 14 is surrounded by a layer 16 of insulation material. Regarding the twisted pairs 18, one conductor 14 of each pair is surrounded by a layer 22 of insulation material that is different from the material of the layer 16 of insulation material of the twisted pairs 12 and the other conductor 14 may be surrounded by a layer 16 of insulation material that is the same as the material layer 16 of the twisted pairs 12. In one preferred embodiment, the plurality of twisted pairs 12 and 18 are surrounded by a cable jacket 24.

In an embodiment wherein the communication cable 10 includes four twisted pairs, two of the twisted pairs are twisted pairs 18 wherein one conductor 14 of each twisted pair 18 has a layer 22 of insulation material different from the insulation material 16 of the other conductor 14 of each twisted pair 18 and different from the insulation material 16 surrounding the conductors 14 of twisted pairs 12.

In one specific embodiment, the communication cable includes two insulated twisted pairs 12 of electrical conductors each having a nominal diameter of about 0.035 inches. This includes an electrical conductor 14 having a nominal diameter of about 0.0206 inches and a layer 16 of insulation having a thickness of about 0.007 inches. For these twisted pairs 12 of electrical conductors the layer 16 of insulation can be any plenum rated insulation as defined by Newmoyer, such as, for example, FEP.

In this embodiment, the communication cable also includes two insulated twisted pairs 18 of electrical conductors. Each of the insulated twisted pair 18 of electrical conductors includes one electrical conductor 14 being covered by a layer 16 of insulation identical to that used for twisted pairs 12. The other conductor 14 of twisted pairs 18 has a nominal diameter of about 0.036 inches and a layer 22 of insulating material having a thickness of about 0.0075 inches. Preferably, the layer 22 of insulation material of the twisted pair 18 is a non-plenum rated material as defined by Newmoyer. For example, such an insulation material 22 may include a highly filled flame retardant olefin combined with a material having favorable electrical properties, such as standard HDPE. As another example, the insulation layer 22 may also include a highly filled smoke suppressed olefin blended with a material such as HDPE. An acceptable material for this purpose is DGDA-1412 manufactured by Union Carbide Corporation. Other compounds or combinations of compounds can be used, for example DGDB-1430 manufactured by Union Carbide (a highly flame retardant masterbatch) combined in a 50/50 to 75/25 ratio with HDPE, commercially available from Quantum/USI and Union Carbide, is a suitable combination. Such combinations improve the flame retardancy and smoke suppression of the material as well as reduce the fuel load by removing HDPE while maintaining electrical performance due to the very good electrical and mechanical properties of the base olefin material.

In another aspect of the present invention, each of the twisted pairs 12 and 18 is provided with a twist length, the term twist length being defined as the distance covered while one conductor makes one complete 360° revolution about the other conductor of the twisted pair. According to this aspect of the invention, the twisted pairs 18 (each having one conductor 14 insulated by a layer 22 of non-plenum rated material) are provided with the longest twist lengths. It has been found that such a configuration does not compromise the desired electrical performance of the communication cable 10, and in fact, provides superior electrical performance as compared to alternate methods of manufacture which utilize combinations of plenum and non-plenum rated materials. Specifically, other methods of manufacture (e.g., as disclosed in Newmoyer) have an inherent weakness in the propagation delay skew requirements for cables of this type.

Velocity of propagation is the rate that a signal can be transmitted over a cable. It is usually expressed in a time-distance format, such as 520 nanoseconds per meter, or as a percentage of light speed. When establishing design criteria for cables, velocity of propagation can be calculated by the following formula:

$$\frac{1}{\sqrt{k}}$$

wherein K is the effective dielectric constant of the insulating material. FEP, for example, has a dielectric constant of 2.02, while the modified olefins can have dielectric constant values as high as 2.6. Due to this difference in dielectric constant, and the resulting difference in velocity of propagation, cables manufactured with modified olefins making-up both conductors of the pairs with the shortest twist lay (greatest distance) have a propensity to perform marginally in respect to the propagation delay skew requirements demanded by the market place.

By utilizing the combination of plenum and non-plenum rated materials in the same pair and providing that pair with the longest twist length, the effect of differing velocities between the materials is mitigated. In addition, by utilizing the non-plenum material in the pair having the longest twist length, the amount of material which is more readily flammable and more apt to produce smoke in the Modified Steiner Tunnel Test is also minimized.

In a preferred embodiment, the communication cable 10 includes a cable jacket 24 that encases the plurality of twisted pairs 12 and the at least two twisted pairs 18. Preferably, the cable jacket 24 is formed from ethylene-trichlorofluoroethylene (E-CTFE). Although the E-CTFE is preferred, other material, such as, for example, polyvinylchloride (PVC) or polymer alloys may also be used.

Figure 2:
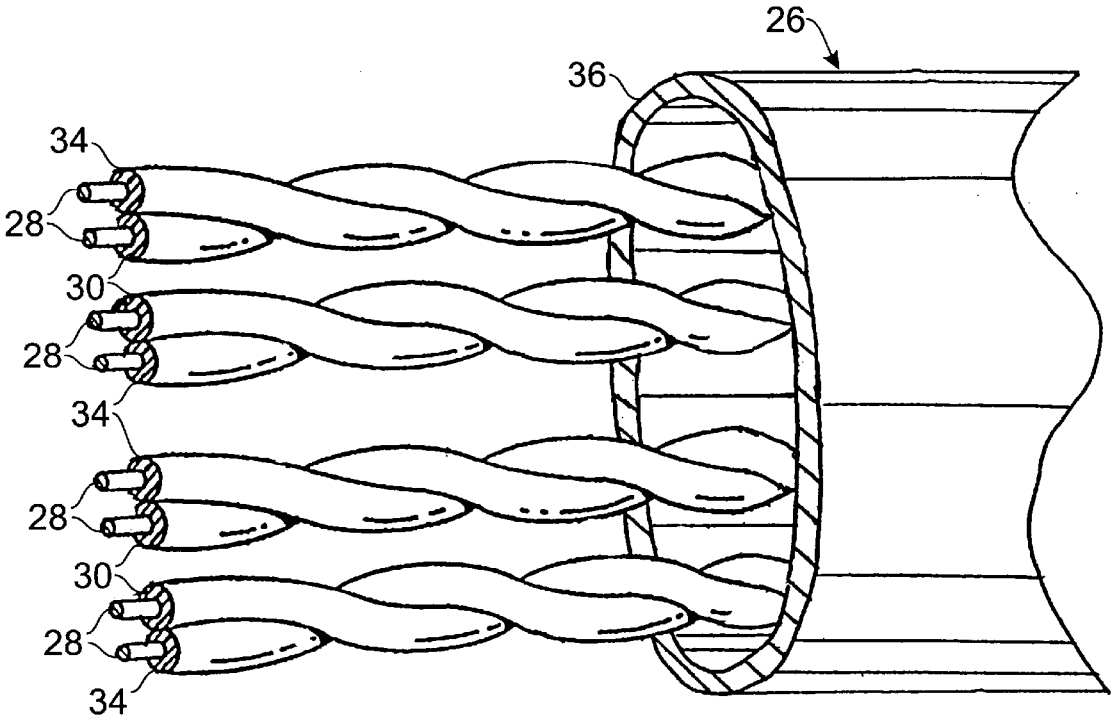
FIG. 2 is a perspective view of another fire retardant plenum cable according to the present invention.

Another communication cable, generally indicated at 26 in FIG. 2 and embodying the principles of the present invention, includes a plurality of twisted pairs 28 of electrical conductors having a first insulating material 30 about one electrical conductor of each pair and a second insulating material 34 about the other electrical conductor of each pair. Smokeguard 024I manufactured by Alpha Gary Corp. has been found to be an acceptable modified olefin, although it should be recognized that other compounds and combinations of compounds are acceptable for this purpose. The communication cable 26 also includes a cable jacket 36 that encases the plurality of twisted pairs 28. The cable jacket 36 is similar to the cable jacket 24 of the communication cable 10 previously described hereinabove and can be formed of the same materials.

The present invention has been described in terms of preferred embodiments thereof. Other embodiments, features and variations within the scope of the invention will, given the benefit of this disclosure, occur to those having ordinary skill in the art.

What is claimed is:

1. A communication cable for use in a plenum, said cable comprising:

a first plurality of twisted pairs of electrical conductors, each electrical conductor of said first plurality of twisted pairs being surrounded by a first insulation material; and a second plurality of twisted pairs of electrical conductors, each of said second plurality of twisted pairs having a first conductor surrounded by said first insulation material, and a second conductor surrounded by a second insulation material, wherein said first insulation material comprises FEP, and said second insulation material includes an olefin base, and wherein said first plurality of twisted pairs have a first twist length and said second plurality of twisted pairs have a second twist length, said second twist length being longer than said first twist length.

2. The communication cable of claim 1 wherein said second insulation material comprises a highly filled flame retardant olefin.

3. The communication cable of claim 2 wherein said highly filled flame retardant olefin is blended with HDPE.

4. The communication cable of claim 3 wherein said blend is at a 50/50 to 75/25 ratio.

5. The communication cable of claim 1 wherein said second insulation material comprises a highly filled smoke suppressed olefin.

6. The communication cable of claim 5 wherein said highly filled smoke suppressed olefin is blended with HDPE.

7. The communication cable of claim 6 wherein said blend is at a 50/50 to 75/25 ratio.

8. The communication cable of claim 1, further comprising a cable jacket, said cable jacket encasing said first and said second plurality of twisted pairs.

9. The communication cable of claim 8 wherein said cable jacket is formed from ethylene-trichlorofluoroethylene.

10. The communication cable of claim 8 wherein said cable jacket is formed from a polymer alloy.

11. The communication cable of claim 8 wherein said cable jacket is formed from polyvinylchloride.

12. A communication cable for use in a plenum, said communication cable comprising:

a plurality of twisted pairs of electrical conductors, each of said twisted pairs having a first electrical conductor and a second electrical conductor;

a first insulating material about each of said first electrical conductors; and a second insulating material about each of said second electrical conductors, wherein said first insulating material comprises FEP and said second insulating material includes an olefin base.

13. The communication cable of claim 12 wherein said second insulating material comprises a highly filled flame retardant olefin.

14. The communication cable of claim 12 wherein said second insulating material comprises a highly filled smoke suppressed olefin.

15. The communication cable of claim 12, further comprising a cable jacket, said cable jacket encasing said plurality of twisted pairs.

16. The communication cable of claim 15 wherein said cable jacket is formed from ethylene-trichlorofluoroethylene.

17. The communication cable of claim 15 wherein said cable jacket is formed from a polymer alloy.

18. The communication cable of claim 15 where said cable jacket is formed from polyvinylchloride.

* * * * *